US006764553B2

(12) United States Patent
Dolan

(10) Patent No.: US 6,764,553 B2
(45) Date of Patent: Jul. 20, 2004

(54) CONVERSION COATING COMPOSITIONS

(75) Inventor: Shawn E. Dolan, Sterling Heights, MI (US)

(73) Assignee: Henkel Corporation, Gulph Mills, PA (US)

( * ) Notice: Subject to any disclaimer, the term of this patent is extended or adjusted under 35 U.S.C. 154(b) by 72 days.

(21) Appl. No.: 09/952,264

(22) Filed: Sep. 14, 2001

(65) Prior Publication Data

US 2003/0051773 A1 Mar. 20, 2003

(51) Int. Cl.[7] ..... C23C 22/00

(52) U.S. Cl. ..... 148/243; 148/247; 148/268; 148/273; 148/275; 148/283; 106/14.11; 252/389.54

(58) Field of Search ..... 148/243, 247, 148/268, 273, 275, 283; 106/14.11; 252/389.54

(56) References Cited

U.S. PATENT DOCUMENTS

| | | | | |
|---|---|---|---|---|
| 4,264,378 | A | 4/1981 | Oppen et al. | 148/6.15 |
| 5,281,282 | A | 1/1994 | Dolan et al. | 148/247 |
| 5,427,632 | A | 6/1995 | Dolan | 148/259 |
| 5,449,415 | A | 9/1995 | Dolan | 148/259 |
| 5,534,082 | A | 7/1996 | Dollman et al. | 148/247 |
| 5,759,244 | A | 6/1998 | Tomlinson | 106/14.14 |
| 5,952,049 | A | 9/1999 | Tomlinson | 427/327 |
| 5,958,511 | A | 9/1999 | Dolan | 427/258 |
| 6,083,309 | A | 7/2000 | Tomlinson | 106/14.21 |
| 6,193,815 | B1 | 2/2001 | Wada et al. | 148/247 |

FOREIGN PATENT DOCUMENTS

| | | |
|---|---|---|
| JP | 56136978 | 10/1981 |
| JP | 2000 249165 | 8/2000 |
| WO | WO9851841 | 11/1998 |
| WO | WO0022188 | 4/2000 |

OTHER PUBLICATIONS

Intl. App. No. 01/26144.
U.S. app. Ser. No. 09/966,276.
U.S. app. Ser. No. 09/965,965.
JP 56–136978 Abstract.

*Primary Examiner*—Andrew L. Oltmans
(74) *Attorney, Agent, or Firm*—Stephen D. Harper; Mary K. Cameron

(57) ABSTRACT

Corrosion resistant, hydrophilic coatings on the surface of aluminum and aluminum alloys may be formed using aqueous compositions containing fluorometallates such as $H_2TiF_6$ or $H_2ZrF_6$ and vanadium compounds such as decavanadates. To minimize the odor evolved from the conversion coatings it is preferred for a specified oxide, hydroxide, carbonate, or alkoxide to also be present in or added to the aqueous composition.

27 Claims, No Drawings

CONVERSION COATING COMPOSITIONS

FIELD OF THE INVENTION

This invention relates to compositions useful for forming conversion coatings on metal surfaces. In particular, this invention pertains to aqueous compositions which, when dried in place on a metallic surface comprised of aluminum, provide a coating having reduced odor characteristics.

DESCRIPTION OF THE RELATED ART

It is well known to treat aluminum and aluminum alloy surfaces with various agents for purposes of rendering the surfaces more resistant to corrosion and enhancing the adherence of top coats and bonded films to such surfaces. Additionally, there are situations in which it will be desirable to impart hydrophilic characteristics to the aluminum-containing surface. For example, aluminum and its alloys are often used to fabricate heat exchangers having a large surface area so as to maximize the heat exchangers' heat dissipating and cooling capacity. In order to minimize the size of the heat exchanger, however, it will generally be desirable to reduce the space between the individual fins of the heat exchanger. If water drops are capable of forming on the heat exchanger surface, this tends to reduce the effectiveness of the heat exchanger since air is no longer able to freely circulate within or pass through the heat exchanger. Increasing the hydrophilicity ("wettability") of the heat exchanger surface will allow such droplets to spread out.

As heat exchangers are often used in air conditioning units wherein air is drawn into such a unit and then expelled into occupied spaces, it is important that the coating does not impart any objectionable odor to the conditioned air. Unfortunately, many of the known technologies for forming corrosion resistant, hydrophilic conversion coatings on aluminum surfaces yield coatings which have a disagreeable or unpleasant smell, particularly when wet. Additionally, certain of these technologies utilize chromium compounds which are undesirable in view of their known environmental and toxicological properties. Further, certain of these technologies employ polymers or other organic substances having rather complex structures and which are therefore often relatively expensive to purchase or synthesize.

Thus, it is apparent that there is still a great need for a process capable of forming a hydrophilic, corrosion-resistant coating on metal surfaces (especially aluminum surfaces) which does not require the use of either chromium compounds or polymeric or other organic substances and which furnishes a coating having little or no odor.

SUMMARY OF THE INVENTION

The present invention provides a composition useful for forming conversion coatings. The composition comprises water, at least one fluorometallate of at least one element selected from the group consisting of Ti, Zr, Si, B, Hf, Sn and Ge, and at least one vanadium compound. In an especially desirable embodiment, the composition is additionally comprised of at least one oxide, hydroxide, carbonate or alkoxide of at least one element selected from the group consisting of Ti, Zr, Si, B, Hf, Sn, Al and Ge or a salt thereof A conversion coating is formed by contacting such composition with the surface of a metal, particularly a metal comprised of aluminum. The composition may thereafter be dried in place without rinsing.

The conversion coatings thus formed are relatively low in odor (especially when the aforedescribed oxide, hydroxide, carbonate or alkoxide component is additionally present in the composition used to form the coating). Moreover, advantageous corrosion resistance and hydrophilic characteristics are imparted to the metal surface without the use of either chromium compounds or polymeric or other organic substances.

DETAILED DESCRIPTION OF THE INVENTION

Except in the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are all by weight or mass; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, or of generation in situ within a combination by one or more chemical reactions, as noted in the description, between other material(s) newly added to the combination and material(s) already present in the combination, and does not necessarily preclude other unspecified chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to one of the objects of the invention); any definition of an acronym or other type of abbreviation applies, without the need for repetition of the definition, to all subsequent uses of the same abbreviation and applies, mutatis mutandis, to grammatical variations of the original meaning and abbreviation; and the term "mole" and its grammatical variations may be applied to elemental, ionic, and any other chemical species defined by number and type of atoms present, as well as to compounds with well defined molecules.

Water is generally used as the carrier or solvent for the other components of the conversion coating composition which is the subject of this invention. However, water-soluble and/or water-miscible solvents such as esters, alcohols, glycols, glycol ethers, ketones, ethers and the like may also be utilized, if so desired.

The compositions should contain (preferably in dissolved form) one or more fluorometallates comprising fluorine and at least one element selected from the group consisting of titanium, zirconium, silicon, boron, hafnium, tin and germanium. Of these elements, titanium, zirconium and silicon are generally preferred, with titanium and zirconium being generally more preferred. Preferably, the fluorometallate contains at least four fluorine atoms per atom of Ti, Zr, Si, B, Hf, Sn or Ge. More preferably, the fluorometallate contains at least five fluorine atoms. Most preferably, six fluorine atoms are present in the fluorometallate. The fluorometallate may be in either acid or salt form; preferably, the fluorometallate is in acid form when the composition is first formulated (it being understood that the fluoroacid may undergo further reactions or interactions upon combining with the other components of the composition). Illustrative examples of suitable fluorometallates include $H_2TiF_6$, $H_2ZrF_6$, $H_2HfF_6$, $H_2SiF_6$, $H_2GeF_6$, $H_2SnF_6$, $HBF_4$ and salts and mixtures thereof. $H_2TiF_6$, $H_2ZrF_6$ and $H_2SiF_6$ are generally most preferred for use in the present invention.

The effectiveness of a treatment according to the invention appears to depend predominantly on the total amounts of the active ingredients that are dried in place on each unit area of the treated metal surface, and on the nature and ratios of the active ingredients to one another, rather than on the precise concentration of each ingredient present in the aqueous composition used. However, as a general guide, it is normally preferable, with increasing preference in the order given if the composition as applied to the metal surface has a concentration of fluorometallate that is at least 0.005, 0.010, or 0.025 gram moles per kilogram (hereinafter, "M/kg") of the total aqueous composition.

The vanadium component of the present invention is preferably any compound containing vanadium which is capable of serving as a source of vanadate anions. Preferably, the vanadium compound is water-soluble and is dissolved in the conversion coating composition. Vanadates of any degree of aggregation may be used to supply the vanadium required in a composition according to the invention. However, decavanadates are most preferred, which shall be understood hereinafter to include not only ions with the chemical formula $V_{10}O_{28}^{-6}$ which are present in decavanadate salts, but also protonated derivatives thereof having the general formula $V_{10}O_{(28-i)}OH)_i$, wherein i is an integer from 1 to 4 (these are believed to be the predominant species present in aqueous solutions having a pH of from 2 to 6). The ortho-, meta-, pyro-as well as more complex isopoly-and heteropoly-vanadates may also be utilized. Sodium ammonium decavanadate is currently most particularly preferred, because it is the least costly commercially available source of decavanadate ions. If other vanadates are used, the counterions are preferably selected from the group consisting of alkali metals and ammonium cations, in view of the insufficient water solubility of most other vanadates.

The concentration of vanadium atoms present in a conversion coating composition according to this invention preferably is at least, with increasing preference in the order giving, 0.00005, 0.0001, or 0.0005 M/kg and independently preferably is not more than, with increasing preference in the order given, 0.1, 0.05, or 0.02 M/kg.

Independently, the ratio of the concentration in M/kg of fluorometallate to the concentration in M/kg of vanadium atoms in a composition according to the invention preferably is at least, with increasing preference in the order given, 0.1:1, 0.5:1, or 1:1 and independently preferably is not more than, with increasing preference in the order given, 500:1, 250:1 or 100:1.

In a particularly preferred embodiment of the invention, the conversion coating composition is additionally comprised of at least one compound which is an oxide, hydroxide, carbonate or alkoxide of at least one element selected from the group consisting of Ti, Zr, Si, Hf, Sn, B, Al, or Ge. The presence of such a compound helps to minimize the odor evolved from the conversion coating. Salts of such compounds may also be used (e.g., titanates, zirconates, silicates). Titanium, zirconium and silicon compounds are most preferred, with zirconium compounds being particularly preferred. Preferably, the oxide, hydroxide, carbonate or alkoxide (or salt thereof) is water-soluble or becomes solubilized when combined and/or heated together with the other components of the composition. Preferably, the compound is fluoride-free. Examples of suitable compounds of this type which may be used to prepare the conversion coating compositions of the present invention include, without limitation, silica, zirconium basic carbonate and zirconium hydroxide.

If present, the concentration of this compound in the conversion coating composition is preferably at least, in increasing preference in the order given, 0.0001, 0.001 or 0.005 M/kg (calculated based on the moles of the element(s) Ti, Zr, Si, Hf, Sn, B, Al and/or Ge present in the compound used) and independently preferably is not more than, with increasing preference in the other given, 0.5, 0.25, or 0.1 M/kg (again, calculated on the basis of the molar amount of the specified element(s) present in the compound used). Independently, the ratio of the concentration in M/kg of fluorometallate to the concentration in M/kg of the oxide, hydroxide, carbonate or alkoxide compound preferably is at least, with increasing preference in the order given, 0.05:1, 0.1:1, or 1:1 and independently preferably is not more than, with increasing preference in the order given, 100:1, 50:1 or 10:1.

An acid such as a mineral acid may be added to adjust the pH of the aqueous composition to the desired level, which generally will be in the range of from about 1 to about 8 (more preferably, about 2 to about 7). Hydrofluoric acid is an example of a suitable acid; HF can also function as a source of free fluoride in the conversion coating composition, which may be desirable to provide in certain embodiments of the invention.

Additional components such as surfactants and biocides may also be present in the conversion coating compositions of the present invention, if so desired. In one desirable embodiment of the invention, however, the conversion coating compositions contain no more than 1.0, 0.10, 0.01, or 0.001 percent organic constituents and more preferably are essentially free (at most preferably, entirely free) of any organic constituent.

To save shipping costs, the conversion coating compositions of the present invention may be packaged and sold in concentrated form. The user may the simply dilute the concentrate with water or other suitable solvent to the desired working concentration.

In one embodiment of the invention, it is preferred that the aqueous composition as described above be applied to a metal surface and dried in place thereon. For example, coating the metal surface with a liquid film of the composition may be accomplished by immersing the surface in a container of the composition, spraying the composition on the surface, coating the surface by passing it between upper and lower rollers with the lower roller immersed in a container of the composition, and the like, or by a mixture of methods. Excessive amounts of the composition that might otherwise remain on the surface prior to drying may be removed before drying by any convenient method, such as drainage under the influence of gravity, squeegees, passing between rollers, shaking, tapping and the like.

If the surface to be coated is a continuous flat sheet or coil and precisely controllable coating techniques such as gravure roll coaters are used, a relatively small volume per unit area of a concentrated composition may effectively be used for direct application. On the other hand, if the coating equipment used does not readily permit precise coating at low coating add-on liquid volume levels, it is equally effective to use a more dilute aqueous composition to apply a thicker liquid coating that contains about the same amount of active ingredients.

Preferably the amount of composition applied in a process according to this invention is chosen so as to result in a total add-on mass (after drying) that is, with increasing preference in the order given, not less than from 50, 100, or 250 milligrams per square meter (hereinafter "$mg/m^2$") of surface treated, and independently is, with increasing preference in the order given, not more than 2000, 1500 or 1000 $mg/m^2$. The add-on mass of the protective film formed by a process according to the invention may be conveniently monitored and controlled by measuring the add-on weight or mass of the metal or metalloid atoms in the fluorometallate (and oxide, hydroxide, carbonate or alkoxide compound, if such compound is present) as defined above. The amount of these metal or metalloid atoms may be measured by any of several conventional analytical techniques known of those skilled in the art. The most reliable measurements generally involve dissolving the coating from a known area of coated substrate and determining the content of the metal and/or metalloid of interest in the resulting solution. The total add-on mass can then be calculated from the known relationship between the amount of the metal in the fluorometallate and the total mass of the part of the total composition that remains after drying. For the purpose of this calculation it is assumed that all water in the working composition, including any water of hydration in any solid constituent added to the composition during its preparation, is expelled by drying but that all other constituents of the liquid film of working composition coated onto the surface measured remain in the dried coating. Preferably, the metal surface bearing the liquid film of the working composition is not rinsed or otherwise treated prior to drying.

In one embodiment of the invention, it is preferred that the conversion coating composition as noted above be applied to the metal surface and dried thereon within a short time interval. In order to facilitate this rapid completion of a process according to this invention, it is often preferred to apply the conversion coating composition used in the invention to a warm metal surface, such as one rinsed with hot water after initial cleaning and very shortly before treating with the conversion coating composition according to this invention, and/or to use infrared or microwave radiant heating and/or convection heating in order to effect very fast drying of the applied coating. In such an operation, a peak metal temperature in the range from 30 °–200° C., or more preferably from 40°–120° C., would normally be preferred.

In an alternative embodiment, which is equally effective technically and is satisfactory when ample time is available at acceptable economic cost, a composition according to this invention may be applied to the metal substrate and allowed to dry at a temperature not exceeding 40° C. In such a case, there is no particular advantage to fast drying.

Surprisingly, it has been found that remarkably uniform coatings are obtained using the process of the present invention even when the wet film thickness (i.e., the thickness of the conversion coating composition film on the metal surface) and drying conditions are not carefully controlled. For example, a metal panel may be dipped into the conversion coating composition for a time effective to wet or coat the entire surface, withdrawn from the conversion coating composition (with excess conversion coating composition being allowed simply to drip off), and then dried (either at ambient or elevated temperatures). The resulting conversion coating will generally vary in weight across the width or length of the metal panel no more than about ±25% from the average coating weight on the entire panel.

Preferably, the metal surface to be treated according to the invention is first cleaned of any contaminants, particularly organic contaminants and foreign metal fines and/or inclusions. Such cleaning may be accomplished by methods known to those skilled in the art and adapted to the particular type of metal substrate to be treated. For aluminum-containing metals, for example, the surface to be treated is preferably first contacted with a conventional hot alkaline cleaner, then rinsed in hot water, then, optionally, contacted with a neutralizing acid rinse before being contacted with an aqueous conversion coating composition as described above.

Once dried, the conversion coating which is formed is adherent and resists re-solubilization. The various components of the aqueous composition should therefore be selected so as to avoid the introduction or formation of species which will leach from the conversion coating. For this reason, it will generally be desirable to exclude water soluble anions such as nitrate, sulfate or acetate from the conversion coating composition.

EXAMPLES

Example 1

A concentrate was prepared by combining the following components:

Deionized Water 791.41 g
Fluorozirconic Acid (20%) 200 g
Sodium Ammonium Decavanadate 0.50 g
Zirconium Basic Carbonate 9.99 g

Example 2

A concentrate was prepared by combining the following components:

Deionized Water 799.5 g
Fluorozirconic Acid (20%) 200 g
Sodium Ammonium Decavanadate 0.50 g

Example 3

A concentrate was prepared by combining the following components:

Deionized Water 879 g
Fluorotitanic Acid (60%) 89 g
Sodium Ammonium Decavanadate 10.0 g
HF (48%) 25 g

Examples 4–6

A 15% solution in deionized water of each of the concentrates described in Examples 1–3 was applied to aluminum heat exchanger cores (4"×4" cube core sections) using the following procedure:

Step 1: The core was cleaned by exposure to a 5% (v/v) aqueous solution of PARCO Cleaner 305 (a product of the Surface Technologies division of Henkel Corporation, Madison Heights, Mich.) at 120° F. (49° C.) for 2 minutes.

Step 2: The core was rinsed with water.

Step 3: The core was rinsed again with deionized water (counterflowed to Step 2).

Step 4: The core is dipped into the 15% solution of the concentrate.

Step 5: The core is oven dried at 130° C.

The odor characteristics of the dry-in-place coatings were evaluated using the following procedure. A small fan is placed behind the coated core section and four individuals are asked to rank the odor emanating from the dry core section according to the following scale:

1. Severe
2. Moderate
3. Slight
4. Very Slight
5. None

The core section is then wetted with deionized water and placed once again in front of the small fan. The odor emanating from the wet core section is again evaluated in accordance with the aforedescribed procedure.

The odor characteristics of the coatings obtained using the compositions prepared in Examples 1–3 are shown in Table 1.

TABLE 1

| Example | Aqueous Composition, Example # | Dry Odor | Wet Odor |
|---|---|---|---|
| 4 | 1 | None | None |
| 5 | 2 | Moderate | Moderate |
| 6 | 3 | Moderate | Moderate |

By way of composition, a conversion coating was formed on aluminum heat exchanger cube core sections using the inorganic composition described in Example 10 of U.S. Pat. No. 5,534,082 in combination with 204.4 parts of a 30.4% organic polymer concentrate described in Example 1 of U.S. Pat. No. 5,281,282. Although the dry odor of this coating was evaluated as "slight", the wet odor was characterized as "severe".

What is claimed is:

1. A composition useful for forming conversion coatings, said composition consisting essentially of:

(a) water;

(b) at least one fluorometallate of at least one element selected from the group consisting of Ti, Zr, Si, B, Hf, Sn, and Ge; and (c) at least one vanadium compound.

2. The composition of claim 1 wherein at least one fluorometallate is selected from the group consisting of fluorometallates of Zr, Ti and Si.

3. The composition of claim 1 wherein at least one fluorometallate is selected from the group consisting of $H_2TiF_6$, $H_2ZrF_6$ and salts thereof.

4. The composition of claim 1 wherein at least one vanadium compound is a vanadate.

5. The composition of claim 1 wherein at least one vanadium compound is a decavanadate.

6. The composition of claim 1 additionally comprising at least one oxide, hydroxide, carbonate or alkoxide of at least one element selected from the group consisting of Ti, Zr, Si, B, Hf, Sn, Al and Ge and salts thereof.

7. The composition of claim 1 comprising a concentration of fluorometallate that is at least 0.005 M/kg.

8. The composition of claim 1 comprising a concentration of vanadium atoms that is at least 0.00005 M/kg.

9. The composition of claim 1 comprising a fluorometallate concentration in M/kg and a vanadium atom concentration in M/kg such that the fluorometallate: vanadium atom ratio is at least 0.1:1.

10. The composition of claim 1 comprising a fluorometallate concentration in M/kg and a vanadium atom concentration in M/kg such that the fluorometallate: vanadium atom is not more than 500:1.

11. The composition of claim 1 having a pH in a range of from 1 to 8.

12. A composition useful for forming conversion coatings, said composition comprising, in the absence of chromium compounds, phosphates and polymeric substances:

(a) water;

(b) at least one fluorometallate of at least one element selected from the group consisting of Ti, Zr and Si;

(c) at least one vanadium compound; and (d) at least one oxide, hydroxide, carbonate or alkoxide of at least one element selected from the group consisting of Ti, Zr, and Si and salts thereof.

13. The composition of claim 12 wherein at least one fluorometallate is selected from the group consisting of $H_2TiF_6$, $H_2ZrF_6$, and salts thereof.

14. The composition of claim 12 wherein at least one vanadium compound is a vanadate.

15. The composition of claim 12 wherein at least one vanadium compound is a decavanadate.

16. The composition of claim 12 comprising silica, zirconium hydroxide, zirconium basic carbonate or a mixture thereof.

17. The composition of claim 12 comprising a concentration of fluorometallate that is at least 0.005 M/kg.

18. The composition of claim 12 comprising a concentration of vanadium atoms that is at least 0.00005 M/kg.

19. The composition of claim 12 comprising a fluorometallate concentration in M/kg and a vanadium atom concentration in M/kg such that the fluorometallate:vanadium atom ratio is at least 0.1:1.

20. The composition of claim 12 comprising a fluorometallate concentration in M/kg and a vanadium atom concentration in M/kg such that the fluorometallate:vanadium atom ratio is not more than 500:1.

21. The composition of claim 12 having a pH in a range of from 1 to 8.

22. The composition of claim 12 wherein component (d) is present in a concentration of at least 0.0001 M/kg.

23. The composition of claim 12 comprising a fluorometallate concentration in M/kg and a component (d) concentration in M/kg such that the fluorometallate: component(d) ratio is at least 0.05:1.

24. The composition of claim 12 comprising a fluorometallate concentration in M/kg and a component (d) concentration in M/kg such that the fluorometallate:component (d) ratio is not more than 100:1.

25. A composition useful for forming conversion coatings, said composition having a pH in a range of from 1 to 8 and comprising, in the absence of chromium compounds and polymeric substances:

(a) water;

(b) a concentration of fluorometallate that is at least 0.005 M/kg, said fluorometallate being selected from the group consisting of $H_2TiF_6$, $H_2ZrF_6$ and salts and mixtures thereof;

(c) a concentration of vanadium atoms that is at least 0.00005 M/kg, at least a portion of said vanadium atoms being provided in the form of one or more decavanadates;

(d) a concentration of one or more compounds selected from the group consisting of titanium oxides, titanium hydroxides, titanium alkoxides, zirconium oxides, zirconium hydroxides, zirconium carbonates, zirconium alkoxides, silicon oxides, silicon alkoxides, and salts and mixtures thereof that is at least 0.0001 M/kg;

wherein the ratio of (b):(c) is in a range of from 0.0:0 to 500:1 and the ratio of (b):(d) is in a range of from 0.05:1 to 100:1.

26. A composition useful for forming conversion coatings, said composition being obtained by combining, in the absence of chromium compounds and polymeric substances:

(a) water;

(b) at least one fluorometallate of at least one element selected from the group consisting of Ti, Zr, Si, B, Hf, Sn, and Ge; and (c) at least one vanadium compound, at least a portion of said vanadium compound being provided in the form of one or more decavanadates.

27. A composition useful for forming conversion coatings, said composition comprising, in the absence of chromium compounds and polymeric substances:

(a) water;

(b) at least one fluorometallate of at least one element selected from the group consisting of Ti, Zr, Si, B, Hf, Sn, and Ge;

(c) at least one decavanadate compound; and (d) at least one oxide, hydroxide, carbonate or alkoxide of at least one element selected from the group consisting of Ti, Zr, and Si and salts thereof.

* * * * *